US005665685A

United States Patent [19]

Takigawa

[11] Patent Number: 5,665,685

[45] Date of Patent: Sep. 9, 1997

[54] GEAR AND TRANSMISSION LUBRICANT COMPOSITIONS OF IMPROVED SLUDGE-DISPERSIBILITY, FLUIDS COMPRISING THE SAME

[75] Inventor: Shoji Takigawa, Yawata, Japan

[73] Assignee: Sanyo Chemical Industries, Ltd., Kyoto, Japan

[21] Appl. No.: 565,306

[22] Filed: Nov. 30, 1995

Related U.S. Application Data

[63] Continuation of Ser. No. 253,053, Jun. 2, 1994, abandoned.

[51] Int. Cl.[6] ..... C10M 137/00; C10M 137/08; C10M 149/00

[52] U.S. Cl. ..... 508/421; 508/433; 508/436; 508/470

[58] Field of Search ..... 252/32.5, 49.8, 252/56 R, 51.5 R; 508/421, 427, 428, 436, 441, 470

[56] References Cited

U.S. PATENT DOCUMENTS

| | | |
|---|---|---|
| 2,892,784 | 6/1959 | Harle et al. . |
| 3,309,317 | 3/1967 | Wittner et al. . |
| 3,640,872 | 2/1972 | Wiley et al. . |
| 3,702,824 | 11/1972 | Schlicht . |
| 3,732,167 | 5/1973 | Foucher et al. . |
| 3,816,315 | 6/1974 | Morduchowitz et al. . |
| 3,892,671 | 7/1975 | Song et al. . |
| 3,897,353 | 7/1975 | Morduchowitz et al. . |
| 4,036,768 | 7/1977 | Crawford et al. . |
| 4,164,475 | 8/1979 | Schieman . |
| 4,606,834 | 8/1986 | Hart et al. . |
| 4,767,551 | 8/1988 | Hunt et al. . |
| 4,800,029 | 1/1989 | Dasai . |
| 4,822,508 | 4/1989 | Pennewiss et al. . |
| 4,867,894 | 9/1989 | Pennewiss et al. . |
| 5,013,467 | 5/1991 | Emert et al. . |

FOREIGN PATENT DOCUMENTS

| | | |
|---|---|---|
| 1 413 677 | 11/1975 | United Kingdom . |

*Primary Examiner*—Prince Willis, Jr.
*Assistant Examiner*—Cephia D. Toomer
*Attorney, Agent, or Firm*—Oblon, Spivak, McClelland, Maier & Neustadt, P.C.

[57] ABSTRACT

A gear or transmission lubricant composition, comprising a major portion of mineral base oil, containing added thereto (A) a phosphorus-containing metal-free organic compound, such as a phosphate ester or amine salt thereof, and (B) an oil-soluble copolymer of (a) an alkyl (meth)acrylate and (b) a N,N-dialkylaminoalkyl (meth)acrylate, shows improved sludge dispersibility, and is useful as automatic transmission fluid.

24 Claims, No Drawings

GEAR AND TRANSMISSION LUBRICANT COMPOSITIONS OF IMPROVED SLUDGE-DISPERSIBILITY, FLUIDS COMPRISING THE SAME

This application is a continuation of application Ser. No. 08/253,053, filed on Jun. 2, 1994, now abandoned.

BACKGROUND OF THE INVENTION

1. Field of the Invention

This invention relates to gear and transmission lubricant compositions, having improved sludge-dispersibility, particularly, those useful for automotive gear and transmission fluids.

2. Description of the Prior Art

Heretofore, in order to improve anti-wear or lubricating qualities and sludge-dispersibility, required for automotive gear and transmission fluids, there have been known those containing added thereto anti-wear or lubricating agents comprising phosphorus-containing organic compound, such as phosphate or phosphite esters or amine salts thereof, together with lower molecular weight dispersants, such as succinimides and benzyl amine. For example, U.S. Pat. No. 4,800,029 discloses an automatic transmission fluid (ATF) comprising a solvent-purified 150 neutral oil, containing added thereto an oleamide phosphate as anti-wear agent and polybutenyl succinimide as dispersant.

These fluids containing added thereto phosphorus-containing organic compounds together with lower molecular weight dispersants, however, have drawbacks, such that dispersabilities become insufficient under severe service conditions likely to form larger sludge, encounterd with friction or wear, accompanied with recent tendency of miniturization and output power up of automobiles; and it is desired to improve the dispersibility.

SUMMARY OF THE INVENTION

It is an object of the present invention to provide a gear or transmission lubricant composition having improved sludge-dispersibility.

It is another object of this invention to provide a gear or transmission lubricant composition capable of providing reduced sludge formation.

It is still another object of the invention to provide a gear or transmission lubricant composition capable of maintaining good sludge-dispersibility even at severe service conditions.

It is yet another object of the invention to provide a gear oil or a transmission fluid, particularly ATF, having improved sludge-dispersibility.

Briefly, these and other objects of the present invention as hereinafter will become more readily apparent have been attained broadly by a gear or transmission lubricant composition, which comprises a major portion of mineral base oil, containing added thereto a minor proportion of (A) at least one phosphorus-containing metal-free organic compound and (B) at least one oil-soluble copolymer containing 92~99% by weight of monomer unis of (a) alkyl (meth) acrylate and 1~8% by weight of monomer unis of (b) N,N-dialkylaminoalkyl (meth)acrylate.

[In the above and hereinafter, (meth)acrylate represents acrylate and/or methacrylate; and similar expressions are used hereinafter].

DETAILED DESCRIPTION OF THE PREFERRED EMBODIMENTS

Base Oil

Suitable base oils used in the present invention include mineral oils, having a viscosity of usually 1~50 cSt (cenlistokes), preferably 2~30 cSt at 100° C. Base oils having a viscosity higher than 50 cSt give rise to energy loss because of too high viscosity resistance. Oils of less than 1 cSt are liable to result in evaporation during use at elevated temperature and to cause seizing on account of shortage of oil film exposed to extreme pressure at lubricationg parts. Viscosity index (hereinafter referred to as VI) of base oils is generally at least 60, preferably at least 70. Oils of VI less than 60 do not provide satisfactory viscosity-temperature properties. Illustrative of suitable base oils are 100 neutral oil, 150 neutral oil, 300 neutral oil, 500 neutral oil, 150 bright stoch and the like.

(A) Phosphorus-containing Organic Compound

Suitable phosphorus-containing metal-free organic compound (A) include phosphate esters, phosphate esters, phosphonate esters, and amine salts of these esters; as well as mixtures of two or more of these compounds.

Examples of these compounds include ones represented by any of the following formulae (1), (2), (3) and (4).

$$O{=}P(OR)_p(OH)_{3-p} \quad (1)$$

$$O{=}P(OR)_q(OH)_{3-q}.\ NH_rR'_{3-r} \quad (2)$$

$$P(OR)_p(OH)_{3-p} \quad (3)$$

$$P(OR)_q(OH)_{3-q}.\ NH_rR'_{3-r} \quad (4)$$

In the formulae (1), (2), (3) and (4), p is an integer of 1, 2 or 3; q and r are independently integers of 1 or 2.

R and R' are independently selected from the group consisting of saturated or unsaturated alkyl groups containing at least 4 carbon atoms, aryl Groups and alkyl-substituted aryl Groups. Examples of R and R' include straight-chain or branched, saturated or unsaturated alkyl groups (aliphatic hydrocarbyl groups) containing 4~30 or more, preferably 4~20 carbon atoms, such as n-, iso-, sec- and t-butyl, hexyl, octyl, 2-ethylhexyl, decyl, dodecyl, tridecyl, tetradecyl, hexadecyl, octadecyl, eicocyl, and oleyl groups; aryl groups, such as phenyl and naphthyl groups; and aryl groups substituted substituted with one or more alkyl groups containing 1~20, preferably 1~10 carbon atoms in the alkyl group, such as tolyl group. These alkyl, aryl and alkyl-substituted aryl groups may be ether group-containing ones, such as lauroxyethyl, lauroxypropyl, oleoxyethyl groups.

Illustrative examples of these compounds of the following formulae (1), (2), (3) and (4) are as follows:

(1) mono-, di- and tri-alkyl and/or aryl phospates, such as mono-oleyl phosphate, tricrezyl phosphate, and dibutyl lauroxypropyl phosphate;

(2) salts of mono- or di-alkyl and/or aryl phospates as above, with mono- or di-alkyl amine, such as di-2-ethylhexyl amine;

(3) mono-, di- and tri-alkyl and/or aryl phospites, such as di-n-butyl phospite, tributyl phospite, (4) salts of mono- or di-alkyl and/or aryl phospites as above, with mono- or di-alkyl amine, such as di-2-ethylhexyl amine.

Phosphorus-containing compounds, as written in C. J. Boner "Gear and Transmission Lubricants" (1964 Reinhold Publishing Corp.), page 94, Table 3.8, may also be used.

Among these phosphorus-containing metal-free organic compound (A), preferred are those of the formula (1), particularly alkyl phosphate containing 4~18 carbon atoms in the alkyl group. The most preferred is mono-oleyl phosphate.

The amount of the phosphorus-containing metal-free organic compound (A), usually 0.01~5%, preferably 0.1~3%, based on the weight of the lubricant composition.

(B) Oil-soluble Copolymer

Suitable alkyl (meth)acrylates (a), constituting said oil-soluble copolymer (B), are ones contains 1~24 carbon atoms in the alkyl group; and include, for example: ($a_1$) C8~20 alkyl (meth)acrylates, such as octyl, decyl, dodecyl, tridecyl, tetradecyl, hexadecyl, octadecyl and eicocyl (meth) acrylates; ($a_2$) C1~4 alkyl (meth)acrylates, such as methyl, ethyl, propyl and butyl (meth)acrylates; ($a_3$) C5~7 alkyl (meth)acrylates, such as pentyl, hexyl and heptyl (meth) acrylates; ($a_4$) C21~24 alkyl (meth)acrylates, such as Nafol 20+ and Nafol 22+ (produced by Kondea-Chemie; and combinations of two or more of them.

Among these, preferred are ($a_1$) (particularly decyl methacrylate and dodecyl methacrylate), and combinations thereof with ($a_2$) (particularly methyl methacrylate).

Suitable N,N-dialkylaminoalkyl (meth)acrylate (b), constituting said oil-soluble copolymer (B), include one by the following formula (5):

$$CH_2{=}\overset{\overset{\displaystyle R_4}{|}}{C}{-}COO{-}R_3{-}\overset{\overset{\displaystyle R_1}{|}}{N}{-}R_2 \qquad (5)$$

wherein $R_1$ and $R_2$ are the same or different alkyl groups containing not more than 10 carbon atoms, $R_3$ is an alkylene group containing 2~10 carbon atoms, and $R_4$ is hydrogen atom or methyl group.

Illustrative of (b) are N,N-dimethylaminoethyl (meth) acrylates, N,N-diethylaminoethyl (meth)acrylates, N,N-diethylaminohexyl (meth)acrylates, N,N-dimethylaminopropyl (meth)acrylates, N,N-dibutylaminooctyl (meth)acrylates, and mixtures of two or more of them. Among these, preferred are N,N-dimethylaminoethyl methacrylate and N,N-diethylaminoethyl methacrylate.

Said oil-soluble copolymer (B) may contain monomer units of (c) one or more of N-vinyl-pyrrolidone and morpholinoalkyl (meth)acrylates, to improve sludge dispersibility. Suitable morpholinoalkyl (meth)acrylates include ones containing 2~4 or more carbon atoms in the alkylene, such as morpholinoethyl and morpholinopropyl (meth)acrylates. Among these, preferred is N-vinyl-pyrrolidone.

Said copolymer (B) may further contain monomer units of (d) one or more additional monomers. Exemplary of additional monomers (d) are aromatic vinyl compounds, such as styrene and vinyltoluene; esters (such as alkyl esters containing not more than 20 carbon atoms in the alkyl group) of unsaturated dicarboxylic acid (such as maleic, fumaric and itaconic acids), for example, dibutyl, dioctyl and dilauryl maleates, and dihexyl, dihexadecyl and dioctadecyl fumarates; and vinyl esters (ones containing not more than 5 carbon atoms in the alkyl group), such as vinyl acetate and vinyl propionate; and so on. Among these, preferred is styrene, in view of VI and bodying effects.

The contents of these monomers units of (a), (b), (c) and (d) in said oil-soluble copolymer (B) are as follows:

| | Usually | preferably |
|---|---|---|
| (a) | 92~99% | 94~98% |
| ($a_1$) | 52~99% | 64~93% |
| ($a_2$) | 0~40% | 5~30% |
| (b) | 1~8% | 2~6% |
| (c) | 0~10% | ~% |
| (d) | 0~30% | 0~20% |

In the above and hereinafter, % represents % by weight.

Copolymer (B) can be produced by usual polymerization techniques, for instance, by radical polymerization of (a) and (b) with or without (c) and/or (d), within a solvent, such as mineral oil. There may be used any polymerization catalysts, for example, azo compounds, such as azobis-isobutyrenitrile (hereinafter referred to as AIBN) and azobis-valeronitrile, and peroxides, such as benzoyl peroxide, cumyl peroxide and lauryl peroxide, with or without chain transfer agents, such as mercaptans (lauryl mercaptan and the like).

Said copolymer (B) is oil-soluble and is effective as a VI improver in addition to dispersant. To attain these effects, (B) has a weight-average molecular weight (hereinafter referred to as $\overline{Mw}$), as measured by GPC (gel permeation chromatography) using calibration curve of polystyrene, of generally 20,000~200,000, preferably 30,000~150,000. Polymer of too high molecular weight causes degradation to form shorter chain polymer when subjected to shearing and cannot maintain necessary viscosity and VI for a long period of time. Polymer of too low molecular weight is to be used in a larger amount in order to attain sufficient viscosity.

The gear or transmission lubricant composition of the present invention, usually contains, as a practical use level of the lubricant, 0.01~5%, preferably 0.05~3%, more preferably 0.1~2% of said phosphorus-containing organic compound (A) and 1~30%, preferably 2~25%, more preferably 3~20% of said oil-soluble copolymer (B).

Concentrate containing (A) and/or (B) in higher concentration than the above range may be prepared, and this is diluted to a level of practical use.

The composition of this invention may further contains one or more additives, usually used in gear and transmission lubricants. Such additives include, for example, detergents, such as sulfonates, salicylates, phenates and naphthenates; dispersants, such as alkenylsuccinimides and Mannich condensates; anti-oxidants, such as thiophosphates, amines and hindered phenols; oiliness additives, such as fatty acids and esters thereof; antiwear agent, other than (A), such as molybdenum dithiophosphate and molybdenum carbamate; and extreme pressure agents, such as sulfur-containing compounds, phosphorus-containing compounds and chlorine-containing compounds. These additives can be used in such amounts: 0~10% of the detergent, 0~10% of the dispersant, 0~5% of the anti-oxidant, 0~3% of the oiliness additive, 0~10% of the antiwear agent, and 0~10% of the extreme pressure agent.

Compositions of the invention, containing said phosphorus-containing organic compound (A) and said oil-soluble copolymer (B), are useful as gear and transmission lubricants, particularly automotive gear lubricants. Excellent effects can be attained especially when used as automatic transmission fluid for torque converters.

Having generally described the invention, a more complete understanding can be obtained by reference to certain specific examples, which are included for purposes of illustration only and are not intended to be limiting unless otherwise specified.

In the following examples, parts represents parts by weight.

Preparation of Copolymers

Into a reaction vessel equipped with a stirrer, a thermometer and a condensor, 150 parts of a mineral oil (100 neutral oil) were charged and heated to 70° C. under an atmosphere of nitrogen. Then, thereto were added dropwise the monomers (parts) written in Table 1 together with 1.7 parts of AIBN and 2.0 parts of lauryl mercaptan over 2 hours at the temperature, followed by heating to 100° for 3 hours to complete the polymerization to obtain a solution of copolymer having $\overline{Mw}$ as written In Table 1.

TABLE 1

| Copolymer | B1 | B2 | B3 | B4 | B5 | b1 | b2 | b3 |
|---|---|---|---|---|---|---|---|---|
| Lauryl methacrylate | 250 | 150 | 150 | 246 | 250 | 250 | 261 | 226 |
| Hexadecyl methacrylate | — | — | 85 | — | — | — | — | — |
| Octadecyl methacrylate | 23 | 23 | — | 23 | 23 | 23 | 27 | 23 |
| Decyl acrylate | — | 96 | — | — | — | — | — | — |
| Methyl methacrylate | 70 | — | 70 | 70 | 55 | 70 | 70 | 70 |
| Butyl methacrylate | — | 70 | — | — | — | — | — | — |
| Dimethylaminoethyl methacrylate | 18 | — | — | — | 15 | — | 3 | 42 |
| Diethylaminoethyl acrylate | — | 22 | — | — | — | — | — | — |
| Dibutylaminoethyl methacrylate | — | — | 18 | — | — | — | — | — |
| Dimethylaminopropyl methacrylate | — | — | — | 15 | — | — | — | — |
| Morpholinoethyl methacrylate | — | — | — | 7 | — | 18 | — | — |
| N-vinyl-pyrrolidone | — | — | — | — | 18 | | — | — |
| Styrene | — | — | 30 | — | — | — | — | — |
| $\overline{Mw}$, $\times 10^3$ | 40 | 61 | 100 | 90 | 88 | 73 | 100 | 98 |

EXAMPLES 1 to 10, and COMPARATIVE EXAMPLES 1 to 6

According to the following Formulation I or II (%), mineral oil compositions were prepared.

| Formulation | I | II |
|---|---|---|
| Each copolymer solution | 10 | 18 |
| Oleyl amine salt of dilauryl phosphate | 1 | — |
| Octyl amine salt of dioleyl phosphate | — | 1 |
| Polybutenylsuccinimide (Hitec E638*) | 3 | — |
| Polyolefin sulfide (TLA369, produced by Texaco) | — | 5 |
| Perbasic calcium sulfonate (Hitec E611*) | 1 | 1 |
| Dialkylzinc dithiophosphate (Amoco 194) | 0.3 | — |
| Dialkylzinc dithiophosphate (Amoco 198) | — | 0.5 |
| 2,6-di-tert-butyl-p-crezole (Lubrizol 817) | 0.2 | — |
| A mineral oil (100 neutral) | 84.5 | 74.5 |

(Notes)
*produced by Ethyl Cooper.

Resistance to oxidation of each composition was evaluated in accordance with JIS K2514, measuring the amounts of sludge (pentane-insoluble matter, %) of Methods A and B. Method A represents the amount of sludge obtained by centrifuging the oil after the test, and Method B represents the amount of sludge obtained by centrifuging the oil to which a flocculant was added after the test. The amounts of Methods A and B show resistance to oxidation, and the difference between the amounts of Methods A and B means sludge dispersability.

The results were as shown in Table 2.

TABLE 2

| Example No. | Example | | | | | Comparative Example | | |
|---|---|---|---|---|---|---|---|---|
| | 1 | 2 | 3 | 4 | 5 | 1 | 2 | 3 |
| Copolymer | B1 | B2 | B3 | B4 | B5 | b1 | b2 | b3 |
| Formulation | I | I | I | I | I | I | I | I |
| Resistance to Oxidation | | | | | | | | |
| Method A | 0.02 | 0.02 | 0.05 | 0.03 | 0.05 | 0.91 | 1.08 | 2.96 |
| Method B | 0.33 | 0.32 | 0.49 | 0.35 | 0.38 | 0.95 | 1.13 | 3.01 |
| Difference | 0.31 | 0.30 | 0.44 | 0.32 | 0.30 | 0.04 | 0.05 | 0.05 |
| | 6 | 7 | 8 | 9 | 10 | 4 | 5 | 6 |
| Copolymer | B1 | B2 | B3 | B4 | B5 | b1 | b2 | b3 |
| Formulation | II | II | II | II | II | II | II | II |
| Resistance to Oxidation | | | | | | | | |
| Method A | 0.05 | 0.03 | 0.06 | 0.03 | 0.05 | 0.90 | 1.23 | 2.99 |
| Method B | 3.35 | 0.32 | 0.36 | 0.39 | 0.35 | 3.94 | 1.28 | 3.05 |
| Difference | 0.30 | 0.29 | 0.30 | 0.36 | 0.30 | 0.04 | 0.05 | 0.06 |

As apparent from Tables 1 and 2, compositions of the present invention provided extremely small amount of sludge and showed excellent sludge dispersibility and resistance to oxidation.

Compositions of this invention, when used as gear and transmission lubricants, particularly automatic transmission fluid for torque converters, can attain excellent sludge dispersibility with remarkably reducing sludge formation.

What is claimed as new and desired to be secured by Letters Patent is:

1. A gear or transmission lubricant composition, which comprises:

a major portion of mineral base oil, having a viscosity of 1~50 cSt. at 100° C. and having a viscosity index of at least 60; containing, based on the weight of the composition, 0.05–3% of (A) at least one phosphorous-containing metal-free organic compound, selected from the group consisting of compounds represented by any of the following formulae (1), (2), (3) and (4):

$$O{=}P(OR)_p(OH)_{3-p} \quad (1)$$

$$O{=}P(OR)_q(OH)_{3-p}.\ NH_rR'_{3-r} \quad (2)$$

$$P(OR)_q(OH)_{3-p} \quad (3)$$

$$P(OR)_q(OH)_{3-q} \cdot NH_rR'_{3-r} \quad (4)$$

wherein p is an integer of 1~3; q and r are independently integers of 1 or 2; R is selected from the group consisting of saturated or unsaturated aliphatic hydrocarbyl groups containing at least 4 carbon atoms and alkyl-substituted aryl groups; R' is selected from the group consisting of saturated or unsaturated aliphatic hydrocarbyl groups containing at least 4 carbon atoms;

and 2–25% of (B) at least one oil-soluble copolymer containing 92~99% by weight of monomer units of (a) alkyl acrylate or methacrylate and 1~8% by weight of monomer units of (b) N,N-dialkylaminoalkyl acrylate or N,N-dialkylaminoalkyl methacrylate.

2. The composition of claim 1, wherein the monomer (a) contains 1~24 carbon atoms in the alkyl group.

3. The composition of claim 1, wherein the monomer (a) comprises ($a_1$) alkyl acrylate or methacrylate containing 8~20 carbon atoms in the alkyl group.

4. The composition of claim 3, wherein the monomer (a) further comprises ($a_2$) alkyl acrylate or methacrylate containing 1~4 carbon atoms in the alkyl group.

5. The composition of claim 1, wherein said copolymer contains 52~99% by weight of monomer units of ($a_1$) alkyl acrylate or methacrylate containing 8~20 carbon atoms in the alkyl group, and 0~40% by weight of monomer units of ($a_2$) alkyl acrylate or methacrylate containing 1~4 carbon atoms in the alkyl group.

6. The composition of claim 5, wherein said copolymer contains 64~93% by weight of monomer units of ($a_1$), and 5~30% by weight of monomer units of ($a_2$).

7. The composition of claim 1, wherein the N N-dialkylaminoalkyl acrylate or N,N-dialkylaminoalkyl methacrylate (b) is a compound represented by the following formula (5):

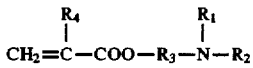

$$CH_2{=}C(R_4){-}COO{-}R_3{-}N(R_1){-}R_2 \quad (5)$$

wherein $R_1$ and $R_2$ are the same or different alkyl groups containing not more than 10 carbon atoms, $R_3$ is an alkylene group containing 2~10 carbon atoms, and $R_4$ is hydrogen atom or methyl group.

8. The composition of claim 1, wherein said copolymer contains 2~6% by weight of monomer units (b).

9. The composition of claim 1, wherein said copolymer further contains up to 10% by weight of monomer units of (c) at least one monomer selected from the group consisting of N-vinyl-pyrrolidone, morpholinoalkyl acrylate and morpholinoalkyl methacrylate.

10. The composition of claim 1, wherein said copolymer further contains up to 30% by weight of monomer units of (d) at least one monomer selected from the group consisting of aromatic vinyl compound, alkyl esters of unsaturated dicarboxylic acid containing not more than 20 carbon atoms in the alkyl group, and vinyl esters.

11. The composition of claim 1, where in said copolymer has a weight-average molecular weight of 20,000~200,000.

12. The composition of claim 1, which further contains at least one additive selected from the group consisting of detergent, dispersant, anti-oxidant, oiliness additive, antiwear agent and extreme pressure agent.

13. The composition of claim 12, wherein 1) the detergent is at least one selected from the group consisting of sulfonates, salicylates, phenates and naphthenates;

2) the dispersant is at least one selected from the group consisting of alkenylsuccinimides and Mannich condensates;

3) the anti-oxidant is at least one selected from the group consisting of thiophosphates, amines and hindered phenols;

4) the oiliness additive is at least one selected from the group consisting of fatty acids and esters thereof;

5) the antiwear agent is at least one selected from the group consisting of molybdenum dithiophosphate and molybdenum carbamate; and 6) the extreme pressure agent is at least one selected from the group consisting of sulfur-containing compounds, phosphorus-containing compounds and chlorine-containing compounds.

14. The composition of claim 13, which contains said additive such amounts as follows:

1) 0~10% by weight of said detergent, 2) 0~10% by weight of said dispersant, 3) 0~5% by weight of said anti-oxidant, 4) 0~3% by weight of said oiliness additive, 5) 0~10% by weight of said antiwear agent, and 6) 0~10% by weight of said extreme pressure agent.

15. The composition of claim 1, wherein said composition is a gear oil.

16. The composition of claim 1, wherein said composition is an automotive gear lubricant.

17. The composition of claim 1, wherein said composition is an automatic transmission fluid.

18. In an automobile assembly, containing therein an automotive gear lubricant, the improvement comprising using as the lubricant the automotive gear lubricant of claim 16.

19. In a torque converter, containing therein an automotive transmission fluid the improvement comprising using as the fluid the automatic transmission fluid of claim 17.

20. The composition of claim 5, wherein ($a_2$) is methyl methacrylate.

21. A method for inhibiting oxidation and improving sludge dispersibility in an automobile assembly which comprises operating the automobile assembly with an automotive gear lubricant according to claim 16.

22. A method for inhibiting oxidation and improving sludge dispersibility in an automobile assembly which comprises operating the automobile assembly with an automatic transmission fluid according to claim 17.

23. The composition of claim 1, wherein said phosphorous-containing metal-free organic compound has formula (2) or (4).

24. The composition of claim 23, wherein R is dodecyl, octadecyl or tolyl and R' is octyl or octadecyl.

* * * * *

UNITED STATES PATENT AND TRADEMARK OFFICE

CERTIFICATE OF CORRECTION

PATENT NO. : 5,665,685

DATED : SEPTEMBER 9, 1997

INVENTOR(S) : SHOJI TAKIGAWA

It is certified that error appears in the above-identified patent and that said Letters Patent is hereby corrected as shown below:

Column 6, line 67, formula (2), "$O=P(OR)_q(OH)_{3-p} \bullet NH_rR'_{3-r}$" should read --$O=P(OR)_q(OH)_{3-q} \bullet NH_rR'_{3-r}$--.

Column 7, line 2, formula (3), "$P(OR)_q(OH)_{3-p}$" should read --$P(OR)_p(OH)_{3-p}$--.

Signed and Sealed this

Thirtieth Day of June, 1998

*Attest:*

Bruce Lehman

BRUCE LEHMAN

*Attesting Officer*

*Commissioner of Patents and Trademarks*